United States Patent [19]

Matej

[11] 4,195,508

[45] Apr. 1, 1980

[54] ADJUSTABLY TIMED THREAD ROLL MACHINE

[75] Inventor: Ronald J. Matej, Parma, Ohio

[73] Assignee: Prutton Corporation, Cleveland, Ohio

[21] Appl. No.: 948,695

[22] Filed: Oct. 5, 1978

[51] Int. Cl.[2] ..... B21H 3/04

[52] U.S. Cl. ..... 72/93

[58] Field of Search ..... 72/92, 91, 93, 102, 72/105, 88, 90

[56] References Cited

U.S. PATENT DOCUMENTS

| | | | |
|---|---|---|---|
| 1,594,657 | 8/1926 | Burns | 72/92 |
| 2,923,186 | 2/1960 | Pierson | 72/92 |
| 3,872,700 | 3/1975 | Matej | 72/91 |
| 4,088,045 | 5/1978 | Grohoshi | 74/813 C |

*Primary Examiner*—Milton S. Mehr
*Attorney, Agent, or Firm*—Louis V. Granger

[57] ABSTRACT

A thread rolling machine is disclosed wherein a continuously adjustable timing screw is used to adjust the phase of the feed of a workpiece relative to the instantaneous position of a rotary die cooperating with a stationary die. This timing substantially eliminates any mismatch of thread rolling by the two dies. The rotatable timing screw adjusts the peripheral position of a cam follower relative to a feed cam by moving the fulcrum point of a bell crank lever on which the cam follower is carried. Rotation of the timing screw adjusts the peripheral position of the cam follower relative to the feed cam. The above description is merely one form of the invention and is not to be construed as limiting on the scope of the invention.

19 Claims, 7 Drawing Figures

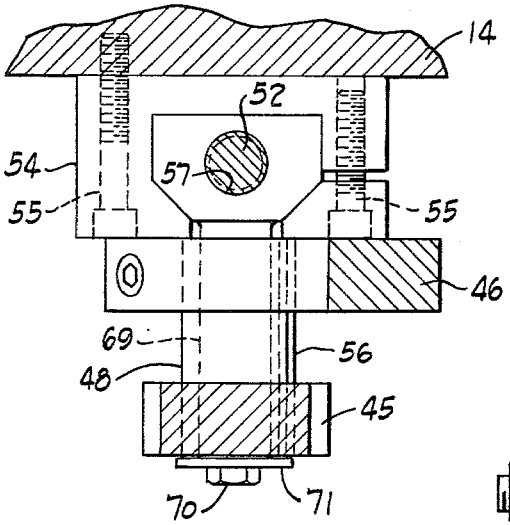
Fig. 3
Fig. 4
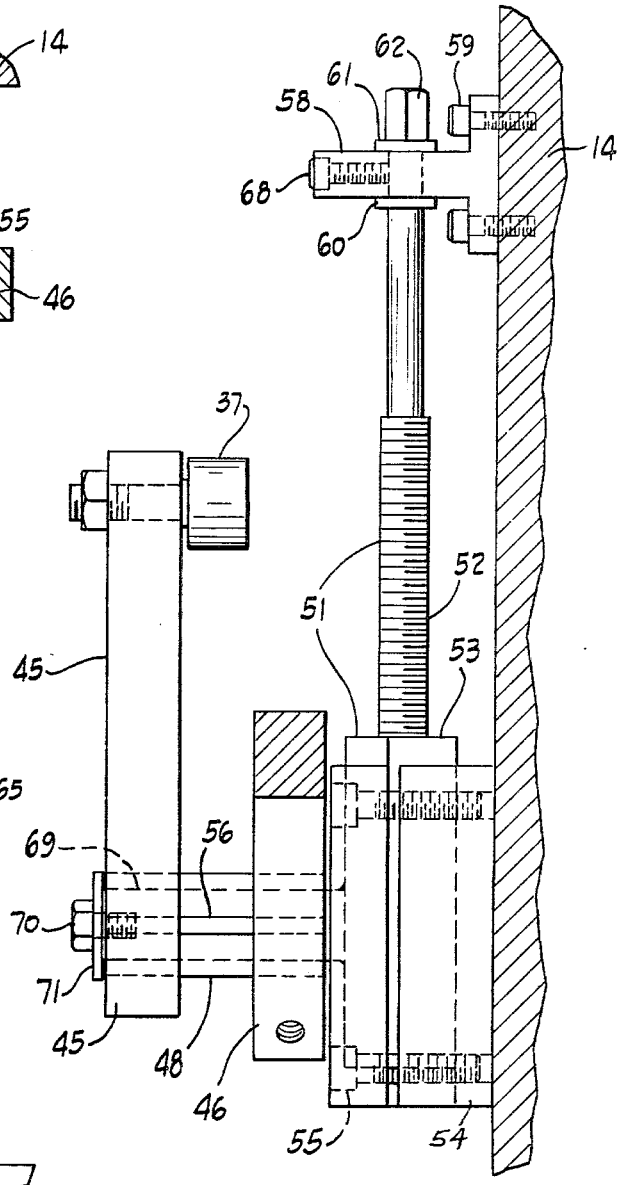
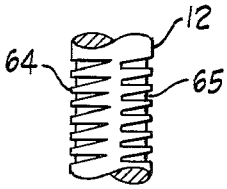
Fig. 5
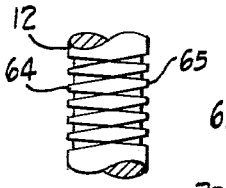
Fig. 6
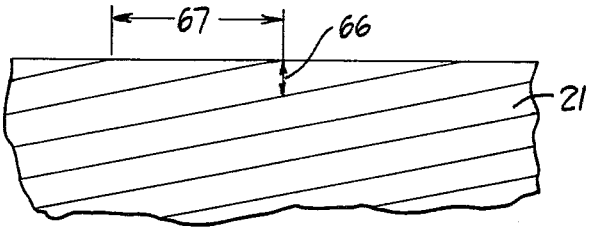
Fig. 7

ADJUSTABLY TIMED THREAD ROLL MACHINE

BACKGROUND OF THE INVENTION

Machines to roll a spiral form on a workpiece, for example, a thread form on a workpiece, have been made in various configurations. Reciprocating flat dies and plural rotary dies have been used, as well as planetary machines with one rotary annular die and one stationary arcuate die.

In planetary machines it was common to have a rotary feed cam rotationally adjustably secured to a first rotary die. This adjustable cam acted through a cam follower and drove a feed finger so that the phase timing of the feed relative to the instantaneous position of the rotary cam could be adjusted to substantially eliminate any mismatch of rolling the thread on the first end of the workpiece. This fixed the time of feeding the workpiece to the dies. This required loosening machine screws and trying to angularly adjust the feed cam through a small angle relative to the rotary die and then retightening the machine screws, then trying the machine again for a one-half rotation of the workpiece and backing it out to determine the amount of mismatch. This had to be repeated several times to obtain proper timing of the workpiece feed relative to the instantaneous position of the rotary cam.

Another prior art planetary machine required the existence of a differential mechanism with a complicated train of gears to obtain a timing which was adjustable while the machine was in operation.

Accordingly, the problem to be solved is how to achieve quicker and more precise timing of a pair of dies relative to the feed of workpiece in order to substantially eliminate any mismatch of the thread forms rolled on the workpiece by the two dies.

SUMMARY OF THE INVENTION

This problem is solved by a work rolling machine to roll a spiral form on a workpiece by a rotary first work rolling die and a complementary second work rolling die, feed means to feed successive work pieces to an entrance area of the second die, the feed means including a rotatable timing wheel rotated in response to rotation of the first die and a follower following the periphery of the wheel, and timing means to adjust the relative phase timing of the dies and the feed of a workpiece by the feed means, the improvement wherein said timing means includes adjustable means connected to adjust the peripheral position of said follower along the periphery of said timing wheel.

An object of the invention is to provide a thread rolling machine with continuously adjustable thread means for timing of the thread rolling dies relative to the workpiece feed.

Another object of the invention is to provide a timing for a thread rolling machine which may be adjusted with the machine in motion.

Another object of the invention is to provide a thread rolling machine in which a continuously adjustable thread means is connected to adjust the peripheral position of a cam follower relative to a feed cam.

Other objects and a fuller understanding of this invention may be had by referring to the following description and claims, taken in conjunction with the accompanying drawings, in which:

BRIEF DESCRIPTION OF THE DRAWING

FIG. 3 is an enlarged sectional view on the line 3—3 of FIG. 2;

FIG. 4 is an enlarged sectional view on the line 4—4 of FIG. 2;

FIG. 5 is an enlarged plan view of a workpiece partially rolled with mismatched threads;

FIG. 6 is an enlarged plan view of a workpiece rolled with matching threads; and FIG. 7 is an enlarged developed view of part of the rotary die.

DESCRIPTION OF THE PREFERRED EMBODIMENT

Figure 1:
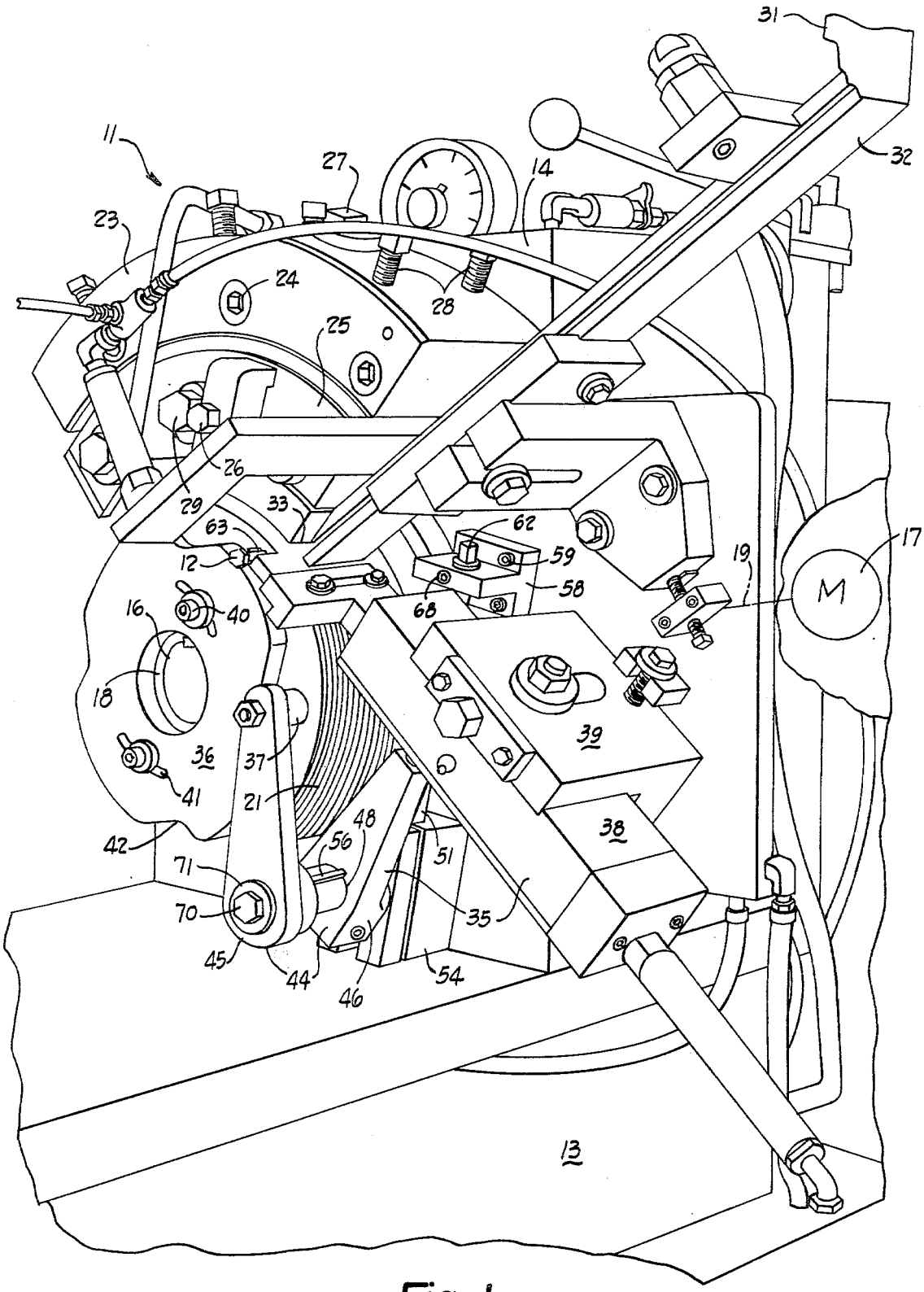
FIG. 1 is a perspective view from the rear of a thread rolling machine embodying the invention.
Figure 2:
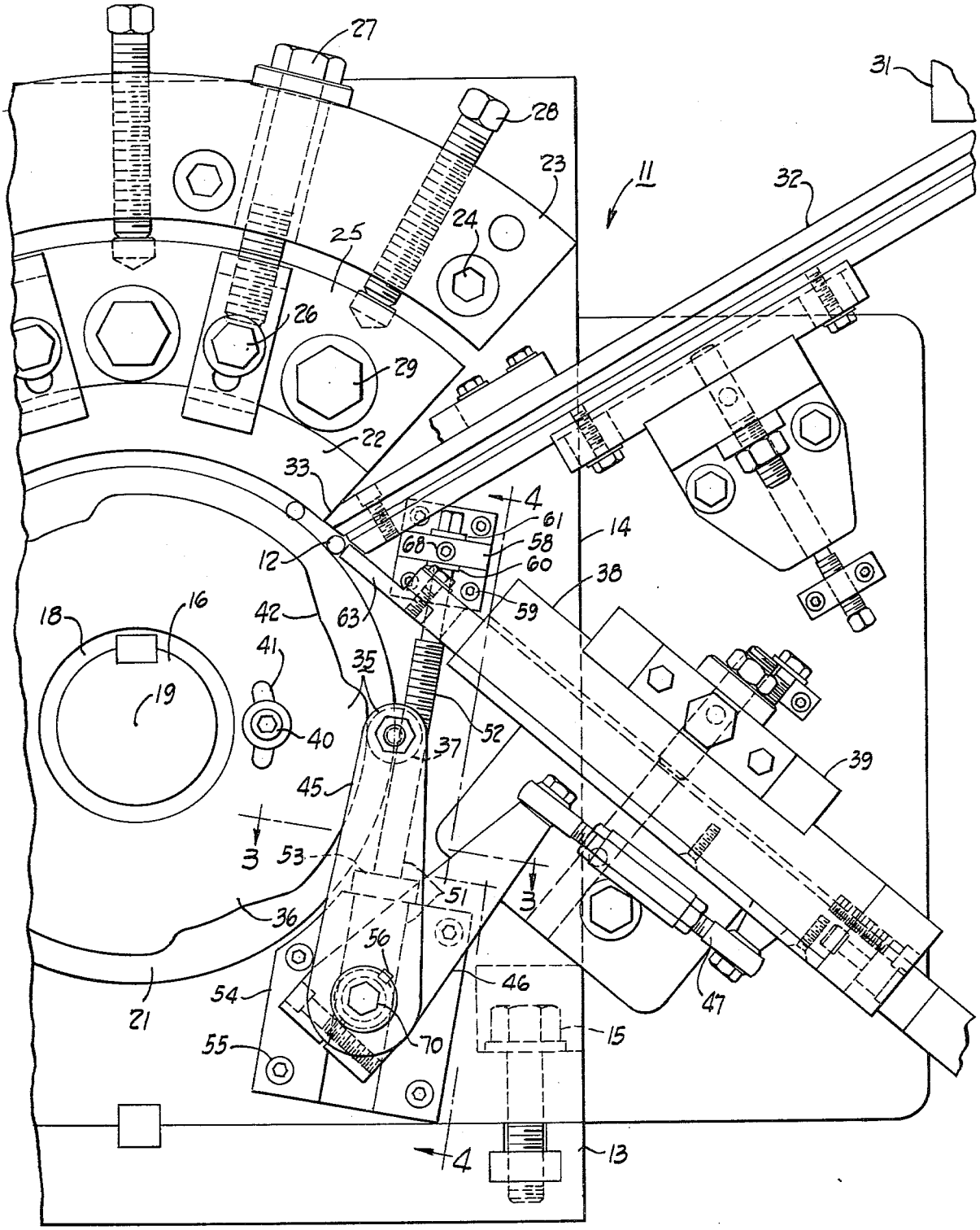
FIG. 2 is an elevational view of the machine and timing means.

The drawing FIGS. 1-4 show a preferred embodiment of the invention incorporated in a thread roll machine 11. This machine may be a double ended machine, but as shown, is only a single-ended machine. It may be used to roll a spiral form on a workpiece, for example, spiral nails or wood screws, but as shown, is set up to roll threads which are axially parallel, e.g., machine screw threads. The machine 11 is shown as being capable of rolling threads on a cylindrical workpiece 12. The machine 11 includes a base 13 having a stationary head 14 secured thereto as by bolts 15. The head journals a rotatable drive shaft 16 which is driven by a motor 17. This motor may be an electrical motor or a hydraulic motor, for example, for easy control of the speed. A spindle 18 is keyed to the drive shaft 16 for rotation therewith and, hence, for rotation about an axis 19.

A rotary first thread rolling die 21 is fixedly secured on the spindle 18. This die is complementary to and cooperates with an arcuate second die 22. This die may be convex and rotary, but as shown, is concave and stationary. The second die circumscribes approximately one-fourth the periphery of the first die. An arcuate die shoe mount 23 is fixed on the head 14 as by screws 24. The arcuate second die 22 is secured to a die shoe 25 by screws 26. The die shoe 25 is adjustably secured to the die shoe mount 23 by machine screws 27 which pull the die shoe 25 toward the mount 23, and by screws 28 which push the die shoe 25 away from the mount 23. After radial adjustment, screws 29 secure the die shoe 25 to the head 14 in an adjustable manner. By proper adjustment of these screws 27 and 28, the proper spacing between the working faces of the dies 21 and 22 may be achieved to roll the proper depth of thread in the workpiece 12.

A workpiece supply is provided to supply a succession of workpieces 12 to the dies 21 and 22. As shown in the preferred embodiment this workpiece supply includes a magazine 31, supplying workpieces down a chute 32 to the entrance end 33 of the second die 22. Feed means 35 is provided to feed successive workpieces on the lower end of the chute 32 to the entrance end 33 of the second die 22. This feed means 35 includes generally a timing wheel 36, a peripheral follower 37 of the wheel 36 and a feed slide 38. The timing wheel is shown as a feed cam 36 having a cam follower 37. The feed slide 38 is mounted on a slide block 39 which may be adjustably secured to the head 14 for proper operation of the feed slide in supplying workpieces to the space between the dies 21 and 22. The feed cam 36 is rotary in some manner, and as shown in the preferred embodiment is caused to rotate by being secured to the spindle 18. It may be secured by means of machine screws 40 passing through arcuate slots 41 and the rotational adjustment of the feed cam 36 in these arcuate slots was the prior art means of timing the feed relative to the dies. The feed cam may have one or a plurality of feed notches 42, and four such feed notches are shown as an illustration.

Lever means is provided between the cam follower 37 and the feed slide 38. This lever means is shown as a bell crank lever 44 which has a first lever arm 45 carrying the cam follower 37 and a second lever arm 46 which is connected to the feed slide 38 by a turnbuckle 47. The two lever arms 45 and 46 are fixed by a key 56 on a fulcrum pivot sleeve 48, journalled on a pivot shaft 69.

Timing means 51 is provided for the timing of the feed of a workpiece relative to the dies 21 and 22. This adjustable timing means includes an adjustable thread means 52, also called a timing screw, connected to move the cam follower 37 peripherally of the feed or timing cam 36 by moving a part of the lever 44. The timing means 51 includes a slide block 53 which is journalled for sliding movement in ways 54 secured by screws 55 to the head 14. The pivot shaft 69 is secured to the slide block 53. A bolt 70 and washer 71 longitudinally secure sleeve 48 to shaft 69. The thread means 52 is a male threaded member threaded into a female thread 57 in the slide block 53. A journal block 58 is secured by screws 59 to the head 14 and journals a cylindrical portion of the timing screw 52. Thrust shoulders 60 and 61 are secured to the timing screw 52 on opposite sides of the journal block 58 to hold this timing screw 52 longitudinally stationary relative to the journal block 58 during rotation. A wrench pad 62 is provided on the outer end of the timing screw 52 for rotation thereof by a suitable tool. The slide block 53 moves generally in the direction of a tangent to the feed cam 36 or in a direction along the length of the second lever arm 46, or some intermediate angle.

OPERATION

When the machine 11 is first set up for thread rolling a part of the workpiece 12, the timing is not known. The timing means 51 adjusts the phase of the feed of a workpiece relative to the instantaneous rotational position of the rotary first die. Successive workpieces 12 are supplied down the chute 32 and are fed by reciprocation of the feed slide 38 which moves a feed finger 63. This feed finger pushes each workpiece into the nip between the two dies 21 and 22. The machine is jogged for about a one-half planetary rotation of the workpiece 12. It is then stopped and reversed to retrieve the workpiece. The workpiece will usually appear as shown in FIG. 5 wherein the threads 64 rolled by die 21 and threads 65 rolled by die 22 are mismatched. The maximum amount of mismatch of the dies is one-half of the pitch dimension 66, shown in FIG. 7. FIG. 7 is an enlarged developed view of part of the rotary die 21 showing this pitch dimension 66 between adjacent thread crests and showing the peripheral dimension 67 between starts of the thread crests along an edge of the die. This peripheral dimension 67 would be equal to the circumference of the workpiece 12 for a single start thread.

To change the timing, the thread means 52 may be rotated. A lock screw 68 is first loosened to permit rotation of this screw 52. If one observes that the workpiece 12, partially rolled, appears as shown in FIG. 5, then there is a mismatch of the feed relative to the dies 21 and 22. The screw 52 may be rotated by a tool, not shown, to move a part of the lever 44. In this preferred embodiment the rotation of the screw 52 moves the fulcrum point 48 and this moves the lever arm 45 generally longitudinally to move the cam follower 37 peripherally along the edge of the feed cam 36. The maximum amount that this cam follower need be moved is one-half the peripheral dimension 67 shown on FIG. 7. When the mismatch between the two dies is substantially eliminated, workpieces 12 may be completely rolled between the two dies 21 and 22. Fine tuning of the timing may be effected while the machine is in operation and then the lock screw 68 locked to secure this timing means 51 in the properly adjusted position. The fact that the lever arm 46 is substantially perpendicular to the turnbuckle 47 means that slight adjustments of the fulcrum point by the timing screw 52 will not affect the length of the stroke of the feed slide 38. The turnbuckle 47 may be used to properly position the feed slide 38 so that the feed finger 63 properly receives the successive workpieces and supplies them to the nip between the dies 21 and 22.

It will be observed that rotation of the timing screw 52 is a means to adjust the peripheral position of the cam follower 37 relative to the feed cam 36. This rotation of the timing screw 52 moves at least a part of the lever 44, and as shown, moves the entire lever by moving the fulcrum point 48. Adjustment of the timing screw 52 adjusts the distance between a fixed point on the machine and the point of engagement of the cam 36 and cam follower 37.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

I claim:

1. In a work rolling machine to roll a spiral form on a workpiece by a rotary first work rolling die and a complementary second work rolling die, feed means to feed successive work pieces to an entrance area of the second die, the feed means including a rotatable timing wheel rotated in response to rotation of the first die and a follower following the periphery of the wheel, and timing means to adjust the relative phase timing of the dies and the feed of a workpiece by the feed means, the improvement wherein said timing means includes adjustable means connected to adjust the peripheral position of said follower along the periphery of said timing wheel.

2. A work rolling machine as set forth in claim 1, including continuously adjustable thread means in said timing means connected to adjust the peripheral position of said follower.

3. A work rolling machine as set forth in claim 1, wherein said timing wheel is connected directly for rotation with said rotary die.

4. A work rolling machine as set forth in claim 1, wherein said timing means includes a lever on which said follower is mounted, and said adjustable means is connected to move a part of said lever.

5. A work rolling machine as set forth in claim 4, wherein said timing wheel is rotatable on an axis and said adjustable means is connected to move said part of said lever relative to said axis.

6. A work rolling machine as set forth in claim 4, wherein said adjustable means is connected to adjust an arm of said lever.

7. A work rolling machine as set forth in claim 4, wherein said adjustable means is connected to adjust the distance between a fixed point on said machine and the point of engagement of said timing wheel and follower.

8. A work rolling machine as set forth in claim 1, wherein said timing wheel is a cam and said follower is a cam follower cooperating therewith.

9. A work rolling machine as set forth in claim 8, wherein said feed means includes a lever to which said cam follower is connected, and said adjustable means is connected to move the fulcrum of said lever on said machine.

10. A work rolling machine as set forth in claim 9, wherein said lever is pivoted on a slide block, ways slidably journalling said slide block on said machine, and said adjustable means is connected to move said slide block relative to said ways.

11. A work rolling machine as set forth in claim 4, wherein said lever has a fulcrum point, a follower actuation point and a feed actuating point, and said adjustable means is connected to move one of said points relative to said machine.

12. A work rolling machine as set forth in claim 9, wherein said adjustable means is connected to move said fulcrum point.

13. A work rolling machine as set forth in claim 1, wherein said adjustable means is adjustable during work rolling operations of the machine.

14. A work rolling machine to roll a spiral form on a workpiece, comprising, in combination;

a base, a rotary first work rolling die rotatably journalled on said base, a complementary second work rolling die mounted on said base to cooperate with said rotary die for rolling a spiral form on a workpiece, feed means mounted on said base and connected to feed successive workpieces to an entrance area of said second die, timing means connected to adjust the relative phase timing of the dies and the feeding of a workpiece by said feed means in order to substantially eliminate any mismatch of spiral rolling by said dies, said timing means including a timing wheel and a peripheral follower thereof, means to cause rotation of said timing wheel in accordance with rotation of said rotary first die, and said timing means including means to adjust the peripheral position of said follower along the periphery of said timing wheel.

15. A machine as set forth in claim 14, wherein said means to adjust includes a continuously adjustable thread means.

16. A machine as set forth in claim 14, wherein said timing wheel is a rotatable cam and said follower is a cam follower thereof.

17. A machine as set forth in claim 16, wherein said timing means includes a lever on which said cam follower is carried.

18. A machine as set forth in claim 17, wherein said adjustable means includes means to adjust the position of part of said lever.

19. A machine as set forth in claim 17, wherein said adjustable means includes a movable slide connected to move a fulcrum of said lever.

* * * * *